US006244472B1

(12) United States Patent
Hennemann

(10) Patent No.: US 6,244,472 B1
(45) Date of Patent: Jun. 12, 2001

(54) DISPENSER FOR LIQUID, CREAM OR GEL WITH A FILTER

(75) Inventor: Pascal Hennemann, Eu (FR)

(73) Assignee: SOFAB (FR)

( * ) Notice: Subject to any disclaimer, the term of this patent is extended or adjusted under 35 U.S.C. 154(b) by 0 days.

(21) Appl. No.: 09/403,745

(22) PCT Filed: Apr. 28, 1998

(86) PCT No.: PCT/FR98/00848

§ 371 Date: Oct. 28, 1999

§ 102(e) Date: Oct. 28, 1999

(87) PCT Pub. No.: WO98/48943

PCT Pub. Date: Nov. 5, 1998

(30) Foreign Application Priority Data

Apr. 28, 1997 (FR) ..... 97 05227

(51) Int. Cl.[7] ..... B67D 5/58
(52) U.S. Cl. ..... 222/189.09; 222/189.11
(58) Field of Search ..... 222/189.09, 189.11

(56) References Cited

U.S. PATENT DOCUMENTS 4,093,124 * 6/1978 Morane et al. ..... 222/189.09
4,533,068 * 8/1985 Meierhoefer ..... 222/189.09
4,694,976 * 9/1987 Schuetz ..... 222/189.09
4,917,271 * 4/1990 Kanner et al. ..... 222/189.09
6,053,368 * 4/2000 Geimer ..... 222/189.09

* cited by examiner

*Primary Examiner*—Joseph A. Kaufman
*Assistant Examiner*—David Deal
(74) *Attorney, Agent, or Firm*—Bacon & Thomas PLLC

(57) ABSTRACT

A dispenser for substances packaged in the form of a liquid, cream, or gel, and particularly intended for cosmetic, dermatological, pharmaceutical, ophthalmic, or perfumery applications. The dispenser includes a tank (1) containing the substance (2) and is connected at one of its ends to a head provided with a pump (4) fitted with a fixing collar (3) and with a controlled shutter device for the vent (40) formed on the body (41) of the pump (4). The shutter device includes an air-permeable diffuser element (6) containing non-migratory agents for bacteriological and/or chemical treatment of air by contact. The diffuser element (6) is engaged on the pump body (41) and held by leakproof peripheral radial clamping of at least one annular zone, and by its top portion being engaged in the fixing collar.

7 Claims, 2 Drawing Sheets

DISPENSER FOR LIQUID, CREAM OR GEL WITH A FILTER

BACKGROUND OF THE INVENTION

1. Field of the Invention

The present invention relates to a dispenser for substances packaged in liquid form, and more particularly intended for cosmetic, dermatological, pharmaceutical, ophthalmic, or perfumery applications. More particularly, the invention relates to a dispenser comprising a flask or tank for the substance, and a closure member having an end valve and/or a pump with an endpiece, in which the surfaces that come into contact with the active principle are designed so as to filter and treat the air that penetrates into the inside of the tank.

2. Description of the Related Art

In conventional manner, four embodiments are known that serve to guarantee that the substance contained inside the tank of a dispenser remains sterile.

In a first embodiment, the substance is packaged in a deformable, flexible bag that forms the tank and that is connected to a pump that has no air intake, commonly referred to as an "airless" pump. The pump is fixed to a rigid flask, thereby holding the flexible bag captive inside the flask. As substance is taken by the user acting on the pump, so the bag shrinks, reducing its capacity by a volume that is equivalent to the volume that has been taken out, and thus leading to the tank becoming deformed.

The drawbacks of that particular embodiment lie firstly in the presence of two packages (the bag and the flask) which increases manufacturing cost, and secondly in the unfavorable ratio between usable volume and total volume. In addition, filling and packaging operations are difficult, in particular for substances that are in the form of creams.

In a second embodiment, the substance is packaged in a cylindrical flask whose bottom is provided with a moving follower piston. As the substance is taken out via an "airless" pump, so the piston rises in the flask, thereby reducing the capacity of the flask by a volume equivalent to the volume taken out.

The drawbacks of that embodiment lie mainly in the cost of the packaging, and in its unsuitability for dispensing a liquid.

In a third embodiment, specifically intended for dispensing liquids, an "airless" pump is connected to a flask which is made of glass and which is therefore not deformable. Such "airless" pumps are capable of operating when the pressure inside the flask is at 0.5 bars, and of still ensuring that doses are regular.

The glass flasks are thus filled with a liquid to 50% relative to the total volume of the flask so as to guarantee that the pressure threshold of 0.5 bars is not reached until the flask has been emptied.

The major drawback of that embodiment lies in the unfavorable ratio between the usable volume and the total volume, and thus in the extra cost generated by the volume of the packaging.

In the fourth known embodiment, constituting the subject matter of French patent application No. 2 740 431 in the name of the same Applicant, an "airless" pump is used that is connected to a flask of a plastics material whose walls are permeable to air.

The drawback of that embodiment lies in the fact that the air passes through the wall of the flask and then through the liquid, which has the effect of slowing down the rate at which air diffuses and the speed at which the extracted dose is replaced.

If the dispenser is used intensively and rapidly, then suction builds up inside the flask and can run the risk of exceeding the operating limit of the pump.

SUMMARY OF THE INVENTION

The present invention seeks to solve all of the technical problems associated with the above-described embodiments, by proposing a system for filtering and treating the intake air flow, thus avoiding the need to use so-called "airless" preservation systems by proposing to use filtered air that is free from bacteria and/or that has a modified oxygen content. The dispenser, which is not restricted to liquids and to creams, makes it possible to fill 90% to 95% of the total volume of the tank.

According to the invention, the dispenser comprises a dispenser for substances packaged in the form of a liquid, cream, or gel, and particularly intended for cosmetic, dermatological, pharmaceutical, ophthalmic, or perfumery applications, the dispenser being of the type comprising a tank of substance connected at one of its ends to a head provided with a pump fitted with a fixing collar and with controlled shutter means for the vent formed on the body of said pump, the device being characterized in that said shutter means comprises an air-permeable diffuser element containing non-migratory agents for bacteriological and/or chemical treatment of air by contact; said element being engaged on the pump body and being held by leakproof peripheral radial clamping of at least one annular zone, and by its top portion being engaged in the fixing collar.

In a first embodiment, the diffuser element is a filter-forming porous core of annular section which is engaged directly on the pump body and which has pores of a size lying in the range 5 $\mu$m to 10 $\mu$m.

Preferably, the mean pore size of the diffuser element is substantially equal to 7 $\mu$m, with an empty fraction lying in the range 40% to 60%.

In a second embodiment, the diffuser element is an elastically deformable sleeve defining a flexible pocket of variable volume around the pump body and whose membrane-forming wall is made out of a material that has intrinsic permeability to air lying in the range 300 $mm^3$/24 h to 5000 $mm^3$/24 h.

In a variant, said material also contains porous fillers.

According to an advantageous characteristic, the material constituting the diffuser element contains anti-oxidizing, bactericidal, antiseptic, and/or atmosphere-modifying treatment agents, in independent or combined form.

The diffuser element used in the dispenser of the invention does not constitute a physical barrier preventing the passage of bacteria as in prior art dispensers, but forms either a filter or a membrane providing a large exchange area for incoming air to enable it to be subjected to bacteriological and/or chemical treatment by coming into contact with nonmigratory agents inside the element.

In addition, both the dimensions of the filter pores and the selective permeability of the membrane combined with the surface tension properties of the materials used, serve to prevent liquids from passing through, thus making the diffuser element hydrophobic and making it possible to prevent bacteria from proliferating inside the tank.

Other characteristics and advantages of the present invention appear from the following description given with reference to the accompanying drawings which show embodiments that are not limiting in any way.

DETAILED DESCRIPTION OF THE PREFERRED EMBODIMENTS

Figure 1:
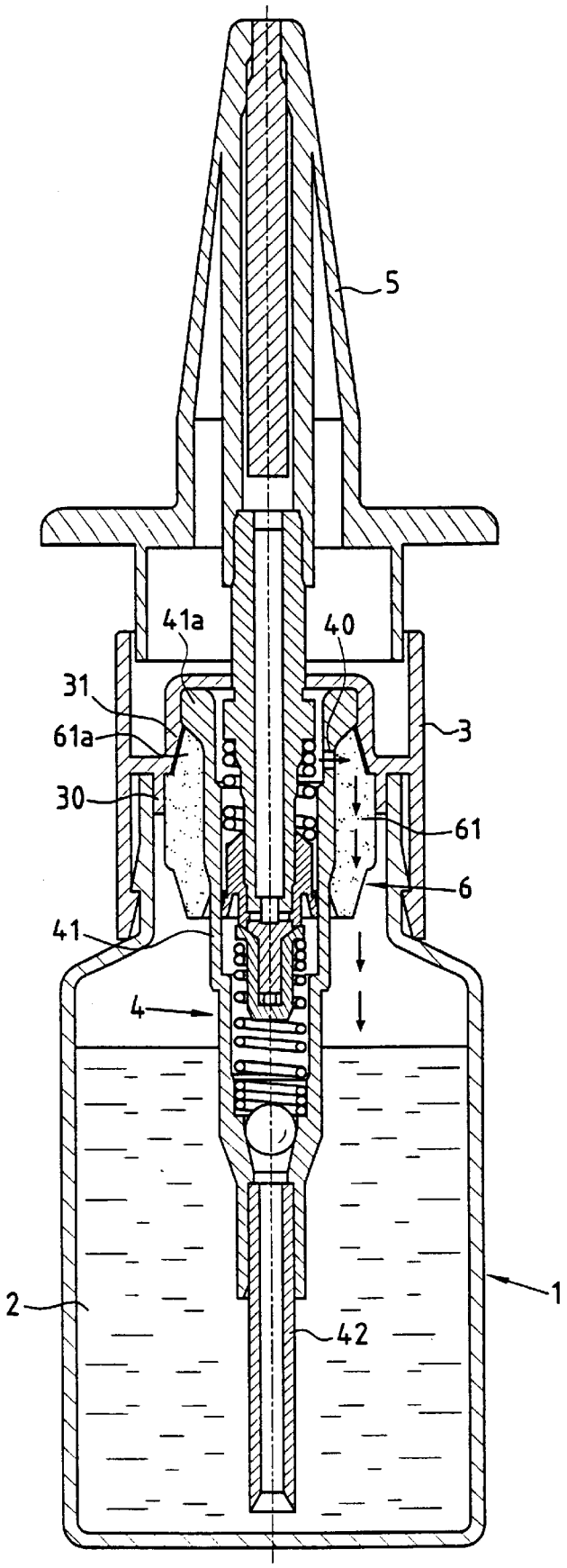
FIG. 1 is a section view in elevation of a first embodiment of the invention.

The dispenser of the invention comprises a tank 1 containing the substance 2 in the form of a liquid, a cream, or a gel. The tank 1, which is preferably rigid or flexible, comprises at one of its ends a head provided with an end valve or a pump 4 that allows ingress of air and that is associated with a cap or an endpiece 5. The body 41 of the pump 4 is extended downwards by a dip tube 42 immersed in the substance 2. The head also has a fixing collar 3 that is locked onto the end of the tank 1, e.g. by snap-fastening, and in which the top edge 41*a* of the body 41 of the pump 4 is held captive.

The body 41 of the pump 4 is of the atmospheric type and thus has a vent hole 40 enabling the volume of liquid substance 2 that is taken from the tank 1 to be replaced by an equivalent volume of air, thereby reestablishing equal pressures between the surroundings and the inside of the tank 1.

According to an advantageous characteristic of the invention, the body 41 of the pump 4 has controlled shutter means at the vent hole 40. This shutter means which is intended to mask the hole 40 comprises an air permeable diffuser element 6 containing non-migratory agents for bacteriological and/or chemical treatment of the air by coming into contact therewith.

The element 6 which is preferably cylindro-conical like the body 41, is engaged on said body and is held thereto in position to close the vent 40 by leakproof peripheral radial clamping of at least one annular zone and by its top portion being engaged in the fixing collar 3. The bacteriological and/or chemical agents are selected to provide bactericidal, antiseptic, anti-oxidizing, or atmosphere-modifying (dehumidifying) treatment by contact. These agents are non-migratory, i.e. they remain fixed within the polymer lattice of the material constituting the diffuser element.

In the embodiment of FIG. 1, the cylindro-conical diffuser element 6 is constituted by a porous core 61 of annular section forming a filter which is engaged directly on the body 41 of the pump 4.

For a pump body 41 whose height is 21 mm, the element 61 is 2 mm to 10 mm high, preferably 7 mm high, and 2 mm to 3 mm thick, preferably 2.3 mm thick. The element 61 is a tight fit radially around the body 41 over its full height.

Thus, the diffuser element 61 provides a large exchange area between the air and the porous material constituting the filter which contains the treatment agent. The path for air containing bacteria is thus relatively long and narrow, thus making it possible to ensure that contact takes place for a duration that is sufficient to ensure that the bacteriological and/or chemical treatment of the air is effective.

In addition, the pores are of a size that is less than or equal to 10 $\mu$m, which in combination with the use of plastics materials such as polyethylene and/or polypropylene, prevents liquids from passing through, thus avoiding any risk of bacteria proliferating inside the tank 1.

The top portion 61*a* of the porous core 61 is of a profile and a shape that are matched to the top portion of the collar 3.

More precisely, the fixing collar 3 has a cylindrical inner ring 30 which fits over the top end of the tank 1 and is in leakproof contact with the inside wall. The ring 30 is extended upwards by a shoulder 31 defining a fastening zone for the top edge 41*a* of the body 41 of the pump 4.

The top portion of the core 61 has a setback 61*a* which is received in complementary manner in the space available beneath the edge 41*a* of the body 41 inside the ring 30.

Figure 2:
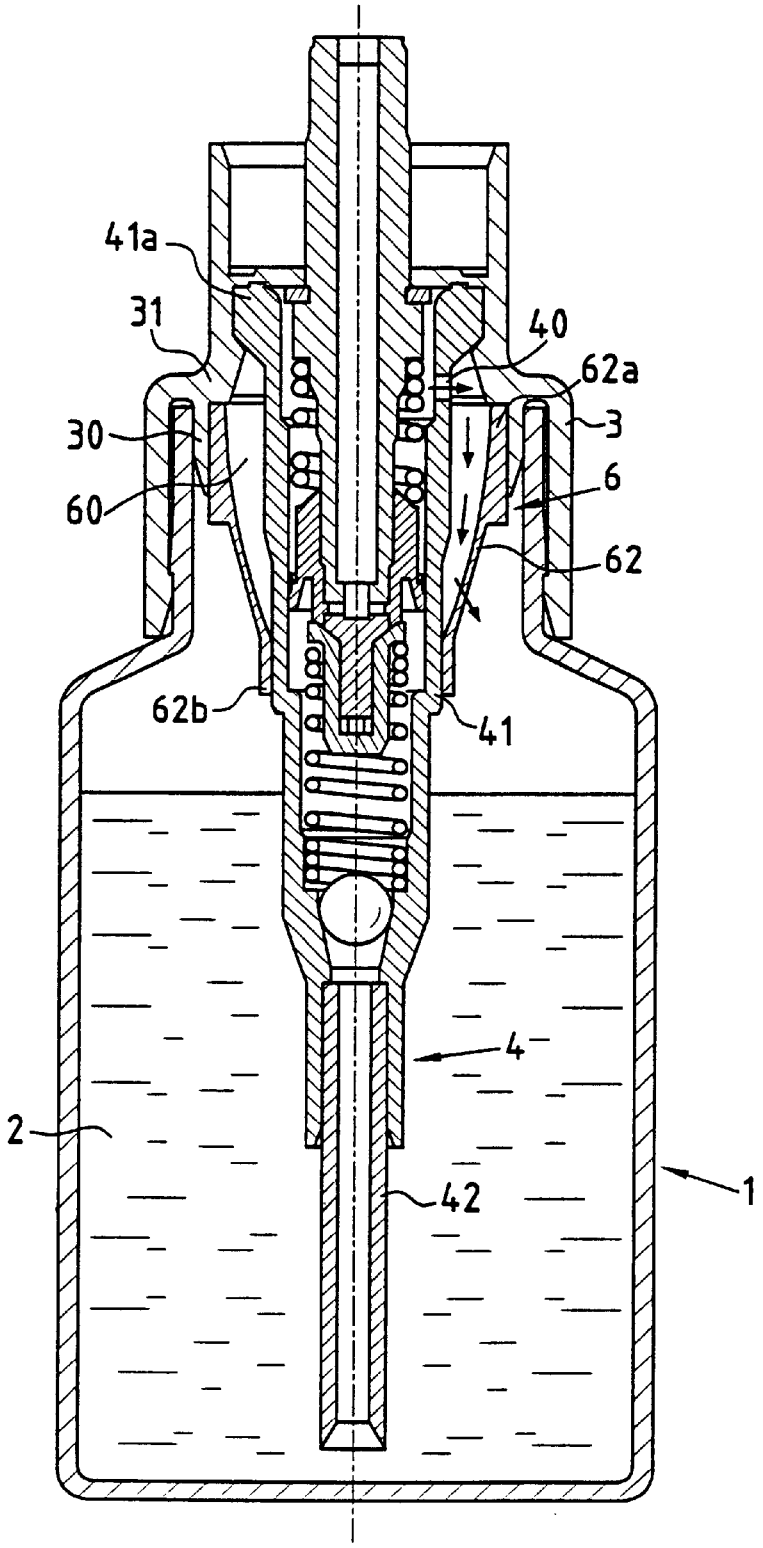
FIG. 2 is a section view in elevation of a second embodiment of the invention.

In the embodiment of FIG. 2, the diffuser element 6 is constituted by a cylindro-conical sleeve 62 that is elastically deformable, defining a flexible pocket 60 of variable volume around the body 41 of the pump 4.

The wall of the pocket 60 thus forms a membrane that is made out of a material whose intrinsic permeability to air lies in the range 300 $mm^3$/24 h to 5000 $mm^3$/24 h.

The volume of air in the pocket 60 at rest lies in the range 100 $mm^3$ to 800 $mm^3$ for a pump body of height equal to 21 mm, thus providing an exchange area lying in the range 3 $cm^2$ to 10 $cm^2$.

The top portion of the sleeve 62 has a cylindrical skirt 62*a* of greater thickness which is engaged in leakproof manner inside the ring 30 of the collar 3. The bottom portion of the sleeve 62 has an annular zone 62*b* that is in a leakproof peripheral radial clamping relationship around the body 41 of the pump 4. By way of example, the sleeve 62 can be made of silicone, polypropylene, or polyethylene, or from a mixture thereof.

If the intrinsic permeability to air of the material used is insufficient compared with the values that are desired, it is possible to incorporate more-permeable fillers in said material, and where appropriate porous fillers.

In a variant (not shown), it is possible to make the diffuser element, particularly when it is in the form of an annular core, by a molding operation that is performed simultaneously with the operation for making the pump body.

In general, the diffuser element 6 can be made using:

plastics material which is obtained by sintering and which is therefore porous; or injected plastics materials, in particular thermoplastic polymers such as polyolefins, PVC, silicones, and technical polymers, having high permeability properties relative to air, containing 20% to 80% of porous additives such as calcareous type fillers and/or fillers of any other type that enable the flow of air through the macro-molecular lattice to be increased.

The three-dimensional lattice of selected macromolecules forming the pores of the annular core 61 enable filtered air to diffuse, while preventing contaminating agents and/or spoiling agents for the substance contained in the tank from passing through.

By an appropriate choice for its component materials, the tank is rigid and therefore retains its shape and its volume after substance has been dispensed. Expelling substance causes the pressure inside the tank to drop, thereby setting up a pressure difference between the inside and the outside of the tank. This pressure difference causes a volume of air corresponding to the volume of liquid substance that has been removed to diffuse into the dispenser at a rate which depends on the permeability characteristics and the dimensions of the diffuser element.

The present invention provides multiple advantages since it enables the toxicity of the substance contained in the tank to be reduced by omitting antibacterial and/or anti-oxygen preserving agents. The dispenser of the invention is thus used in sterile manner with the extracted volume being compensated, thus making it possible to obtain a working volume that can be as great as 99%, while not diminishing the effectiveness of the pump.

Naturally the present invention is not limited to the embodiments described and shown above, but covers all variants thereof.

What is claimed is:

1. A dispenser for liquid, cream or gel substances, the dispenser comprising:

a pump (4) comprising a pump body (41);

a fixing collar (3);

a tank (1) filled with a substance (2), the tank comprising a head portion, the head portion provided with the pump (4) fitted with the fixing collar (3);

a vent (40) formed on the body (41) of the pump (4); and a controlled shutter device for the vent (40), the shutter device comprising an air-permeable diffuser element (6), the diffuser element (6) comprising non-migratory agents for bacteriological and/or chemical treatment of air upon contact, the diffuser element (6) engaged on the pump body (41) and being held thereon by leak-proof peripheral radial clamping of at least one annular zone, and by the top portion of the diffuser element (6) engaged in the fixing collar (3).

2. The dispenser according to claim 1, wherein the diffuser element (6) comprises a filter-forming porous core (61) with an annular section which is engaged directly on the pump body (41) and which has pores of a size lying in the range 5 $\mu$m to 10 $\mu$m.

3. The dispenser according to claim 2, wherein the mean pore size of the diffuser element (6) is substantially equal to 7 $\mu$m, with an empty fraction lying in the range 40% to 60%.

4. The dispenser according to claim 1, wherein the diffuser element is an elastically deformable sleeve (62) defining a flexible pocket (60) of variable volume around the pump body and whose membrane-forming wall is made out of a material that has intrinsic permeability to air lying in the range 300 $mm^3$/24 h to 5000 $mm^3$/24 h.

5. The dispenser according to claim 4, wherein said material comprises porous fillers.

6. The dispenser according to claim 1, wherein the diffuser element is comprised of material selected from a group consisting of anti-oxidizing, bactericidal, antiseptic, and atmosphere-modifying treatment agents.

7. The dispenser according to claim 1, wherein the dispenser is for cosmetic, dermatological, pharmaceutical, ophthalmic or perfumery applications.

* * * * *